United States Patent [19]

Stelling

[11] 3,964,420

[45] June 22, 1976

[54] ADJUSTABLE ANCHOR

[76] Inventor: William Taylor Stelling, 175 W. 72nd St., New York, N.Y. 10023

[22] Filed: Aug. 18, 1975

[21] Appl. No.: 605,790

[52] U.S. Cl. ..... 114/208 R
[51] Int. Cl.[2] ..... B63B 21/44
[58] Field of Search ..... 114/208 R, 208 A

[56] References Cited

UNITED STATES PATENTS

| | | | |
|---|---|---|---|
| 527,061 | 10/1894 | House et al. | 114/208 R |
| 2,610,601 | 9/1952 | Gardiner | 114/208 R |
| 3,030,906 | 4/1962 | Danforth | 114/208 R |

*Primary Examiner*—Trygve M. Blix
*Assistant Examiner*—Gregory W. O'Connor
*Attorney, Agent, or Firm*—Allison C. Collard

[57] ABSTRACT

An exchangeable anchor assembly, comprising a shank having a free end adapted to be connected to a line, with two parallel plates disposed at an opposite end of the shank sandwiching the shank therebetween. A stock is rotatably disposed between the plates perpendicular to the stem, the cross bar having a non-rounded cross section. Two flukes each have an opening substantially the same as the cross section of the stock and are slidable thereon frm opposite ends thereof. Two stabilizers are disposed nonrotatably on the ends of the stocks and are releasable secured thereto. Cam projections cooperating with the plates limit the rotatable movement of the stock relative to the shank.

9 Claims, 8 Drawing Figures

ADJUSTABLE ANCHOR

The present invention relates to an anchor assembly of removable and interchangable parts which can easily be taken apart by the user for storage and quick reassembly.

There is no single perfect anchor for all situations due to the fact that bottom conditions are different everywhere.

Accordingly, it is an object of the present invention to provide an improved anchor assembly which has removable interchangeable parts to be used for reassembly suited to varying botton conditions.

Light weight anchors having cross members with one or a plurality of flukes are well known. The ability to move the flukes and exchange them is also known. However, there are no known anchors which offer an assembly of multiple shaft and multiple fluke combinations which can be used to accommodate different weather conditions and which include different metals to produce a substantially lighter anchor as in accordance with the present invention.

It is another object of the present invention to provide a light weight anchor which permits assembly of multiple shaft and multiple fluke combinations which can be used to accommodate different weather conditions and which include different metals to produce a substantially lighter anchor.

It is still another object of the present invention to provide a light weight interchangeable anchor which is useful for varying bottom conditions, inexpensive in cost and simple in assembly to interchange parts.

The present invention has been described in Unites States Patent Disclosure Document No. 038,150, filed Jan. 27, 1975 in the United States Patent Office, which hereby is referenced herein by incorporation.

The system in accordance with the present invention further offers the possibility of extension of the anchor onto the stock bar to add additional units on tandem, as well as the possibility of connecting to the rear turn buckle.

A trip line with float serves a dual purpose as a marker to locate the anchor and as a quick and easy manner to pull up the end of the anchor to release the flukes from the mud or sand or other condition holding the anchor. With the present invention, a trip line generally will release the flukes.

The unit in accordance with the present invention may be taken apart completely and be readily stored.

The system in accordance with the present invention can be made in many ways which other anchors cannot come close to matching in alternatives and choices for the cruising man. Removable flukes and removable parts are all standardized with the present invention for easy replacement. It offers different shaped flukes for different types of bottom conditions; e.g., shovel-type flukes for sand and very soft bottoms, spike-type flukes ("pitons") to dig in on coral and stone, and a standard fluke.

Basically the present invention comprises essentially two anchors which have at least the same holding power as previous anchors. The assembly of the present invention can be made in two basic sizes. Each version will fit any system since they are designed to be compatible. They may be made, for example, of marine grade aluminum, galvanized iron, steel, and ferroconcrete. Ferrocontrete made of Portland V No. 5 cement will cure forever in sea water and will gain strength; after decades in the water, it will be stronger later than at the beginning.

With the present invention, the cutter can be removed from the deck areas, and the anchoring ground tackle can be removed below the deck areas for storage.

Relating to the anchor of the invention, cams, the length of which determine the angle of the flukes, up or down, are inserted between the plates (or flanges of an H-beam) by having a square hole suitably large for sliding over the removable crossbar (or, stock) for a friction fit, thus lending the strength of four sides and surfaces in the holding action of the anchor; the key points of which are these cams, two for each anchor.

The system of the invention allows for making any standard anchor already known and in existence and widespread use, by standardizing these parts, as being removable from each other and being made in such fashion so as to be modular to the extent that each part can be interchanged with the next larger size anchor. For example: the medium size flukes can be utilized on the small size anchor simply by placing two shanks in series and bolting them securely, thereby making a medium size shank for a medium size anchor.

Other objects and features of the present invention will become apparent from the following detailed description taken in connection with the accompanying drawings which disclose several embodiments of the invention. It is to be understood, however, that the drawings are designed for the purposes of illustration only, and are not intended as a definition of the limits and scope of the invention disclosed.

In the drawings, wherein similar reference characters denote similar elements throughout the several views.

Figure 1:
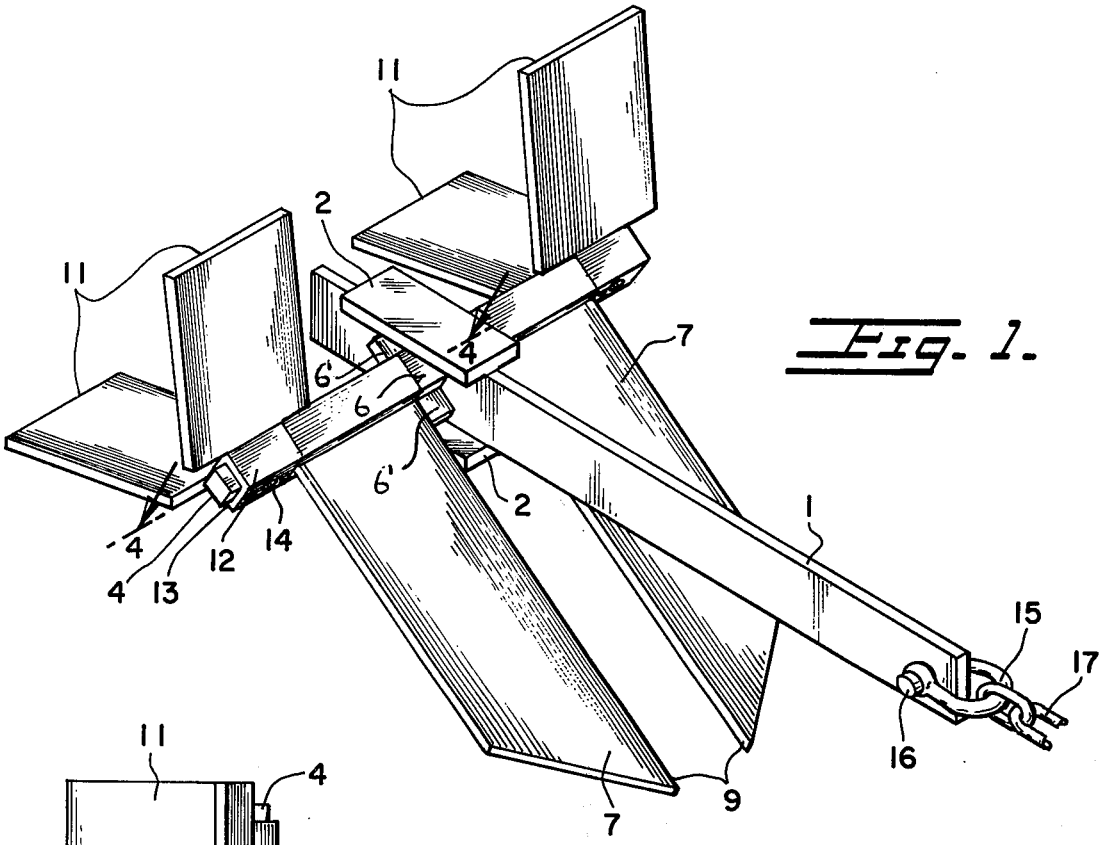
FIG. 1 is a perspective view of an interchangeable anchor system in accordance with the present invention.
Figure 2:
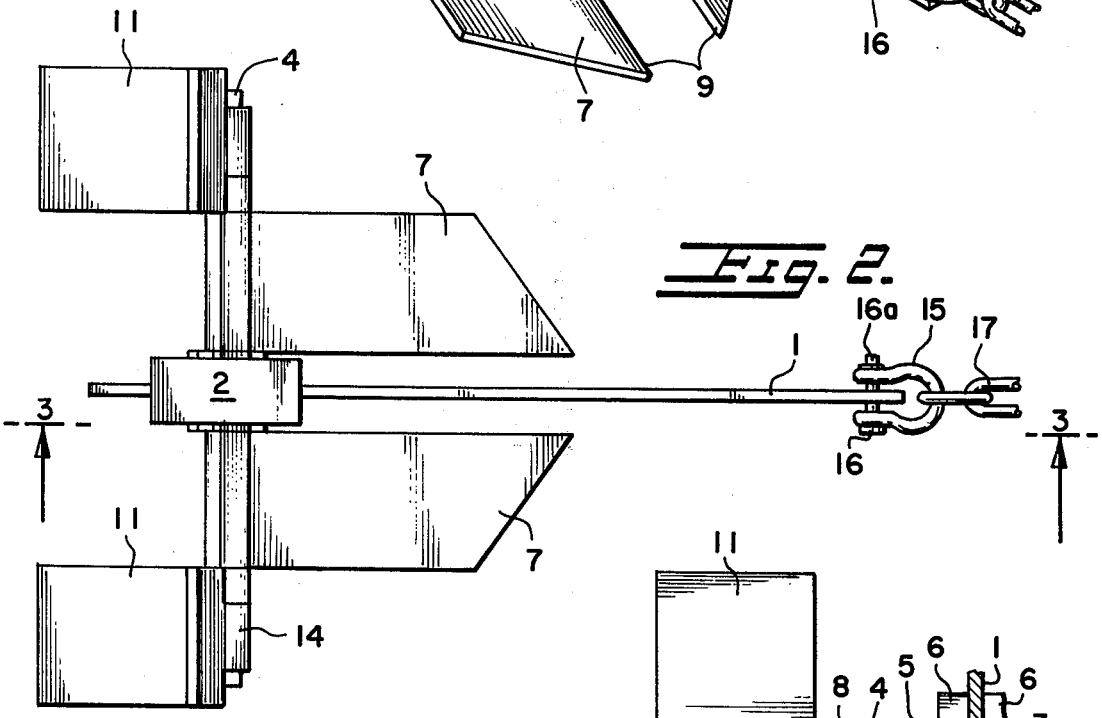
FIG. 2 is a top plan view of the assembly of FIG. 1.
Figure 4:
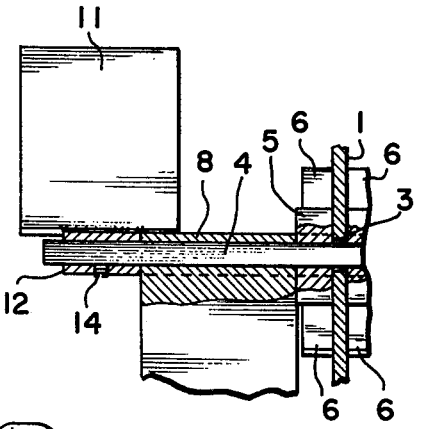
FIG. 4 is a partial broken away section taken along the lines 4—4 of FIG. 1.

Referring now to the drawings and more particularly to FIGS. 1–4 in accordance with the present invention, an assembly is provided having a stem, shank or stock bar 1 of rectangular configuration. (Thus, at the outset it is seen that the present invention saves weight by eliminating the prior use of H-beams and I-beams with their full length flanges.) Welded to the stem 1 at a front portion thereof on opposite sides are parallel rectangular plate members 2, sandwiching the stem 1. The stem 1 is formed with an opening 3 in the front portion thereof in which a cross bar or stock 4 of substantially square shaped cross section is rotatably inserted. Slip over or cut out blocks 5 having an opening 6 therein of a cross sectional shape complementary to that of the cross bar 4 is slipped onto the cross bar 4 on each side of the stem 1.

Figure 3:
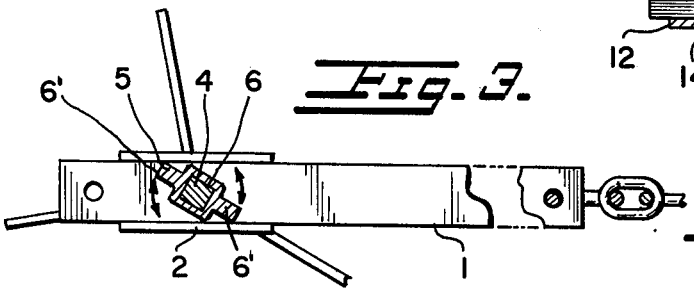
FIG. 3 is a section taken along the lines 3—3 of FIG. 2.

The cut out is formed with outwardly extending projections 6, linearly arranged on opposite sides thereof. The projections 6 are adapted to limit the rotational movement of the bar 4 when it is turned, since the projections 6 hit the welded strip plates 2 as indicated in FIG. 3, after preferably a 30° or smaller or larger degree angles, as well, rotational movement is attained in either direction. Flukes 7 having an elongated opening 8 of a cross-section complementary to that of the cross bar 4 are next slid over the cross bar 4 and positioned adjacent the cut out blocks 6 or cams, which are preferably welded or stamped out of steel in production. The flukes 7 have pointed ends 9 which are adapted to dig into the bottom of the ground to hold the anchor secure. The cut out blocks 6 with their cam projections 6 determine the angular position of the cross bar 4, and the flukes 7 relative to the stem 1. Stabilizers or "trippers" are provided, each stabilizer vane constituting an assembly of two vane plates 11 connected together, preferably at an angle from between 40° to 50°, being secured to a sleeve member 12. The sleeve member 12 is formed with an opening 13 of complementary cross section to that of the bar 4 and is next slid on the cross bar 4 at the ends thereof and held securely thereto by a screw or bolt 14. The stabilizers clock the flukes 7 therebetween on the cross bars 4.

In operation when the anchor is thrown, the lowermost vanes 11 in FIG. 1 lie flat on the ground and the upper vanes 11 point upwardly, thereby directing the flukes 7 downwardly at an angle into the ground for grabbing. The flukes 7 are oriented angularly between the two vanes 11 of each stabilizer.

The front end of the stem 1 is provided with a turn buckle 15 which is pivoted through an opening in the stem 1 connected thereto by a suitable type of fastener. A chain or line 17 is attached to the turn buckle 15 which holds the anchor to the ship. Preferably, although not limited thereto, the connecting means comprises a bolt 16 and nut 16*a* combination.

Figure 5:
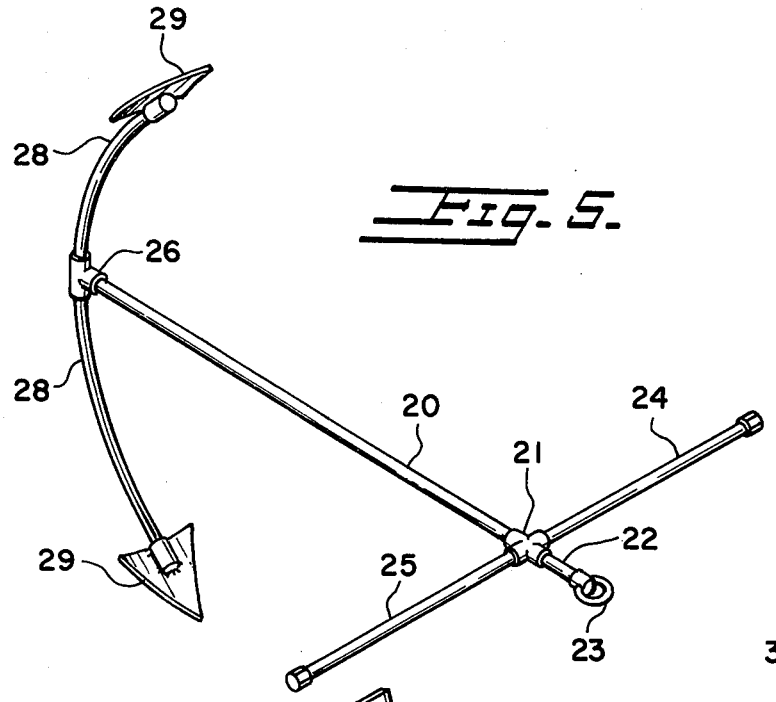
FIG. 5 is a view of another basic type anchor formed in accordance with the present invention.
Figure 6:
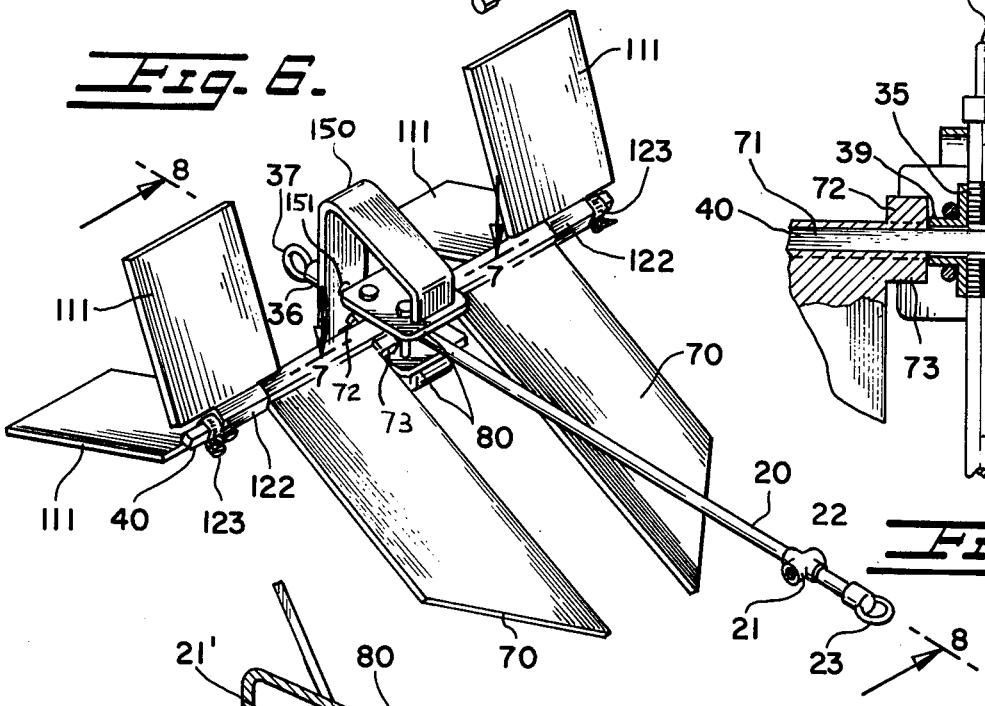
FIG. 6 is a perspective view of another anchor assembly in accordance with the present invention using parts of the anchor of FIG. 5.

Referring now to the drawings and more particularly to FIGS. 5 and 6, a Kedge-type anchor is provided which is formed of a stem 20 and a cross bar piece 21 having four inside threads. One end of the stem 20 is screwed to the cross bar piece 21, with another bar 22 being screwed at the opposite connection portion, the bar 22 having a turn buckle 23 thereon. Two cross arms 24 and 25 are screwed to opposite joints of the cross bar piece 21. At the front end of the stem 20, a simple T-joint 26 is provided with three inside threaded joints. The other end of the stem 20 is screwed to the base joint of the T-joint, and two annular curved bars 28 are screwed to the opposite screw threaded joints of the T-joint 26. The free ends of the curved bars 28 are provided with spades, or flukes 29.

Figure 7:
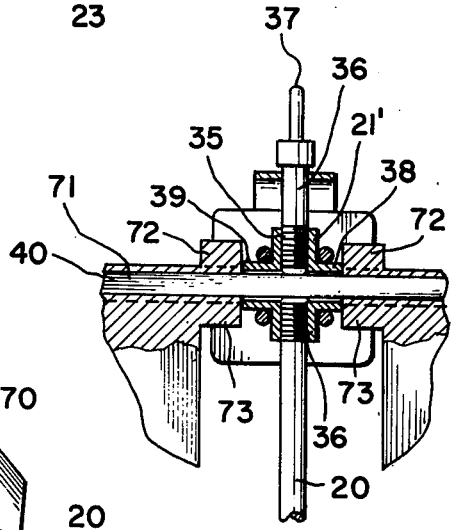
FIG. 7 is a section taken along the lines 7—7 of FIG. 6.
Figure 8:
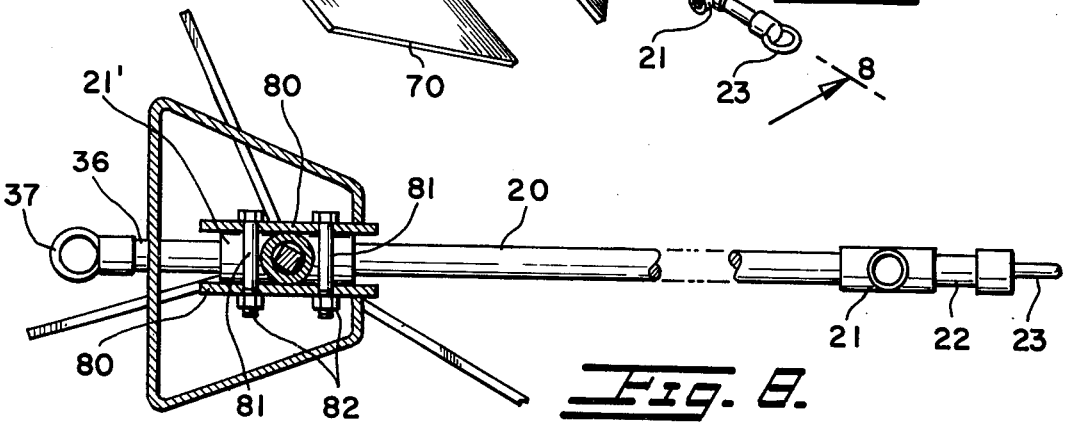
FIG. 8 is a section taken along the lines 8—8 of FIG. 8.

When it is desired to change the anchor design for a different ground condition, the T-joint 26 can be disassembled from the stem 20, and the cross arms 24 and 25 are removed as shown in FIG. 6. A cross joint 21' is provided instead, which is screwed to the front of the stem 20 (FIG. 7). The cross joint 21' only has screw threaded colinear joints constituting openings 35 and 36, the opening 36 being screwed to the threaded end of the stem 20. Another short bar 36 is screwed into the opening 35. A turn buckle 37 is connected to the free end of the bar 36, on which a float may be attached by a line (not shown) to locate the anchor and for aid when additional pulling is required to raise the anchor. The lateral openings 38 and 39 of the T-joint 21' are formed without screw threads and are slightly larger in cross section than that of a bar 40 preferably of square cross section which is inserted rotatably therethrough. Flukes 70, adapted for the particular ground condition, and having an elongated opening 71 substantially complementary to the cross sectional shape of the cross bar 40 which are slid from opposite sides of stem 1 onto the opposite ends of the cross bar 40. The non-rounded cross section of the cross bar 40 holds the flukes 70 thereon in non-rotatable relative thereto. However, the bar 40 may be rotated and therewith the flukes 70 with respect to the stem 20.

The flukes 70 are formed with inwardly extending cam projections 72 and 73 substantially colinearly and parallel to the flukes 70, the cam projections 72 and 73 being adapted to abut upper and lower plates 80 which are sandwiched above and below the stem 20. The plates 80 are operatively clamped to the stem 20 therebetween by bolts 81 with nuts 82 screwed thereon. When the bar 40 is turned, the projections 72 and 73 abut the upper and lower plates 80, respectively, limiting the turning movement of the flukes 70 and cooperatively therewith to approximately 30° relative to the stem 20.

In order to lock the flukes 70 in the assembly, similar to the embodiment of FIGS. 1–4, stabilizers are provided with angularly spaced vanes 111 secured to a sleeve 112. The sleeve 112 has an opening substantially complementary to the cross-sectional shape of the cross bar 44 and is slipped thereon, one on both ends thereof. A suitable locking member, such as a lock strap 123, may be fastened next to the extreme ends of the sleeve 122 of the stabilizers to hold them on the cross bar 40, and thus also the flukes 70 therebetween.

If it is desired for greater anchoring, another fluke unit 111 comprising flukes 70 and stabilizers may be added in tandem by unscrewing the bar 36 and connecting another stem member to the joint of the cross piece bar 21'. A protective collar 150 (which is an optional member) extends from a front end of the plates 80 widening in a direction therebehind and has an opening 151 through which the rear bar 36 extends.

While only a few embodiments of the present invention have been shown and described, it will be obvious that many changes and modifications may be made thereunto without departing from the spirit and scope of the invention.

What is claimed is:

1. An exchangeable anchor assembly, comprising a stem having a free end adapted to be connected to a line, two parallel plates disposed at an opposite end of said stem sandwiching said stem therebetween, a cross bar rotatably disposed between said plates perpendicular to said stem, said cross bar having an unround cross section, two flukes each having an opening substantially the same as the cross section of said cross bar and slidable thereon from opposite ends thereof, two stabilizers each comprising two vane plates angularly disposed relative to each other and a sleeve connected to each of said vane plates and having an opening substantially equal to that of said cross bar and disposed on the ends thereof, means for securing said two stabilizers on said cross bar, thereby holding said flukes therebetween, and projection cam means operatively mounted on said cross bar and having cam projections cooperating with said plates, permitting relative rotatable movement of said cross bar and for limiting the rotatable movement of said cross bar when said cam projections abut said plates.

2. The exchangeable anchor assembly as recited in claim 1 wherein said stem comprises a substantially rectangular bar and said plates are welded thereto.

3. The exchangeable anchor assembly as recited in claim 1 wherein said cross bar has a substantially rectangular cross section.

4. The exchangeable anchor assembly as recited in claim 1 wherein said projection cam means comprises two cut out bars having said cam projections thereon and constituting separate members, each having an opening complementary to that of said cross bar and slidable thereon between one of said flukes and said stem.

5. The exchangeable anchor assembly as recited in claim 1 wherein said stem comprises a substantially tubular-shaped bar, a T-joint connection having threaded joints and releaseably connected to said opposite end of said bar stem, and curved bars having flukes thereon and having opposite ends releaseably screwed to said T-joint.

6. The exchangeable anchor assembly as recited in claim 5 further comprising an interchangeable cross joint having linear opposite screw connections, one of said screw connections being screwable to said opposite end of said stem, said cross joint thereof having two lateral openings of a substantially larger cross section than that of said cross bar, the latter extending rotatably through said two lateral openings, bolt and lock nut means clamping said plates to said cross joint therebetween, and a short bar screw connectable to the other of said screw connections, and said short bar including having a turn buckle thereon adapted to be connected to another line.

7. The exchangeable anchor assembly as recited in claim 6 wherein said releaseable securing means constitutes a bolt or screw.

8. The exchangeable anchor assembly as recited in claim 1 wherein said releasable securing means comprises a strap fastener with bolts.

9. The exchangeable anchor assembly as recited in claim 1 wherein said flukes include inwardly directed portions having said projections integrally thereon.

* * * * *